US006624592B1

(12) United States Patent
Dunphy et al.

(10) Patent No.: US 6,624,592 B1
(45) Date of Patent: Sep. 23, 2003

(54) PROCEDURES AND APPARATUS FOR TURNING-ON AND TURNING-OFF ELEMENTS WITHIN A FIELD EMISSION DISPLAY DEVICE

(75) Inventors: James C. Dunphy, San Jose, CA (US); Donald J. Elloway, Campbell, CA (US)

(73) Assignees: Candescent Intellectual Property Services, Inc, Los Gatos, CA (US); Candescent Technologies Corporation, Los Gatos, CA (US)

( * ) Notice: Subject to any disclaimer, the term of this patent is extended or adjusted under 35 U.S.C. 154(b) by 27 days.

(21) Appl. No.: 10/025,084

(22) Filed: Dec. 18, 2001

Related U.S. Application Data

(63) Continuation-in-part of application No. 09/767,329, filed on Jan. 22, 2001, now Pat. No. 6,459,209, which is a continuation of application No. 09/493,698, filed on Jan. 28, 2000, now Pat. No. 6,307,325, which is a continuation of application No. 09/144,675, filed on Aug. 31, 1998, now Pat. No. 6,104,139.

(51) Int. Cl.[7] ..... G09G 3/10; G09G 3/22; H01J 1/62; H01J 9/00

(52) U.S. Cl. ..... 315/169.4; 315/169.3; 313/496; 313/495; 345/75; 345/76; 445/5; 445/53; 445/59

(58) Field of Search ..... 315/169.4, 169.3, 315/169.1; 313/496, 495, 498, 502; 345/75, 76, 74, 77; 445/5, 53, 59, 41, 55, 73

(56) References Cited

U.S. PATENT DOCUMENTS 6,013,980 A * 1/2000 Goel et al. ..... 313/495
6,147,450 A * 11/2000 Fritz et al. ..... 313/495
6,409,564 B1 * 6/2002 Browning et al. ..... 445/24

* cited by examiner

*Primary Examiner*—Don Wong
*Assistant Examiner*—Tuyet T. Vo
(74) *Attorney, Agent, or Firm*—Wagner, Murabito, & Hao LLP

(57) ABSTRACT

A method of removing contaminant particles from faceplates in newly fabricated field emission displays so that a uniform distribution of contaminants is achieved at the emitter sites of the display. During the initial operation of a field emission dislay device contaminants are removed from the display faceplate by electron induced desorption. The emission current profile at the emitter sites is selected so that the distribution of readsorbed contaminants is equalized. The variations in current emission compensate for shadowing effects due to spacer walls to produce a uniform readsorption distribution. The emitter sites may driven using an animated contrast image at a constant current for the display.

20 Claims, 15 Drawing Sheets

400

500

600

PROCEDURES AND APPARATUS FOR TURNING-ON AND TURNING-OFF ELEMENTS WITHIN A FIELD EMISSION DISPLAY DEVICE

This patent application is a continuation-in-part of, and claims priority to, U.S. application Ser. No. 09/767,329, filed Jan. 22, 2001, now U.S. Pat. No. 6,459,209 which is a continuation of U.S. application Ser. No. 09/493,698, filed Jan. 28, 2000, now U.S. Pat. No. 6,307,351 which is a continuation of U.S. application Ser. No. 09/144,675, filed Aug. 31, 1998 now U.S. Pat. No. 6,104,139.

FIELD OF THE INVENTION

The present invention pertains to the field of flat panel display screens. More specifically, the present invention relates to the field of flat panel field emission display screens.

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This requires the distance from the electron source to the screen to be very small compared to the distance required for the scanning electron beams of the conventional CRTs. In addition, FEDs consume far less power than CRTs. These factors make FEDs ideal for portable electronic products such as laptop computers, pocket-TVs, personal digital assistants, and portable electronic games.

One problem associated with the FEDs is that the FED vacuum tubes may contain a minute amount of contaminants which can become attached to the surfaces of the electron-emissive elements, faceplates, gate electrodes (including dielectric layer and metal layer) and spacer walls. These contaminants may be knocked off when bombarded by electrons of sufficient energy. Thus, when an FED is switched on or switched off, there is a high probability that these contaminants may form small zones of high pressure within the FED vacuum tube. In addition to the fact that the gate is positive with respect to the emitter, the presence of the high pressure facilitates electron emission from emitters to gate electrodes. The result is that some electrons may strike the gate electrodes rather than the display screen. This situation can lead to overheating of the gate electrodes. The emission to the gate electrodes can also affect the voltage differential between the emitters and the gate electrodes. In addition, as the electrons jump the gap between the electron-emissive elements and the gate electrode, a luminous discharge of current may also be observed. Severe damage to the delicate electron-emitters may also result. Naturally, this phenomenon, generally known as "arcing," is highly undesirable.

Conventionally, one method of avoiding the arcing problem is by manually scrubbing the FED vacuum tubes to remove contaminant material. However, it is difficult to remove all contaminants with that method. Further, the process of manual scrubbing is time-consuming and labor intensive, unnecessarily increasing the fabrication cost of FED screens.

In addition to the problem of arcing produced by pressure increases associated with the electron induced desorption of contaminant species from the faceplate and other surfaces, there is also a problem involved with the distribution of the particles after desorption. Ideally, the desorbed contaminants are trapped by a getter in the tube; however, in practice, the desorbed species may be adsorbed and desorbed many times from various surfaces before being gettered, and when the desorbed contaminant species are deposited non-uniformly on the emitter surfaces, the display uniformity is affected.

The intensity of the emission current from an emitter element is a function of the work function at the surface of the emitter. Adsorbed chemical species may either increase or decrease the work function. For example, methane molecules adsorbed on the tip of a molybdenum emitter will enhance emission by reducing the work function, whereas adsorbed oxygen will reduce emission by increasing the work function.

Since FEDs are vacuum devices, the faceplate must be supported by spacer walls if it is of a significant size. The presence of the spacer walls produces local variations in the distribution of redeposited desorbed species from.the faceplate, and this non-uniformity may appear as banding in the display. Accordingly, the present invention provides an improved method of removing contaminant particles from the FED screen. The present invention also provides for an improved method of operating field emission displays to prevent gate-to-emitter currents during turn-on and turn-off. These and other advantages of the present invention not specifically described above will become clear within discussions of the present invention herein.

SUMMARY OF THE DISCLOSURE

The present invention provides for a method of removing contaminant material in newly fabricated field emission displays. According to one embodiment of the present invention, contaminant particles are removed by a conditioning process, which includes the steps of: a) driving an anode of a field emission display (FED) to a predetermined voltage; b) slowly increasing an emission current of the FED after the anode has reached the predetermined voltage; and c) providing an ion-trapping device for catching the ions and contaminants knocked off by emitted electrons. In this embodiment, by driving the anode to the predetermined voltage and by slowly increasing the emission current of the FED, contaminant particles are effectively removed without damaging the FED.

The present invention also provides for a method of operating FEDs to prevent gate-to-emitter current during turn-on and turn-off. In this embodiment, the method includes the steps of: a) enabling the anode display screen; and, b) enabling the electron-emitters a predetermined time after the anode display screen is enabled. In this embodiment, by allowing sufficient time for the anode display screen to reach a predetermined voltage before the emitter is enabled, the emitted electrons will be attracted to the anode. In this way, gate-to-emitter current is effectively eliminated when an FED is turned on. In the present embodiment, the anode display screen is enabled by applying a predetermined high voltage to the display screen, and the electron-emitters are enabled by driving appropriate voltages to the gate electrodes and emitter electrodes of the FED.

In yet another embodiment of the present invention, the method of operating field emission displays to prevent gate-to-emitter current includes the steps of: a) disabling the emitters for a predetermined time; and, b) disabling the anode display screen after the electron-emitters are disabled. In this embodiment, by allowing sufficient time for the electron-emitters to be disabled before disabling the anode display screen, all remaining electrons will be attracted to the anode. In this way, gate-to-emitter current is eliminated during a turn-off sequence of the FED. In the present embodiment, the anode display screen and electron emitters are disabled by switching off the votage source and allowing the potential to decay to ground.

A further embodiment of the present invention includes a method of operating a field emission display so that the flux of contaminant species produced by electron induced desorption during a conditioning period results in a uniform distribution of contaminant species on the emitters.

Embodiments of the present invention include the above and further include a method of operating a field emission display, the method comprising the steps of: providing the field emission display with electron-emissive elements for emitting electrons, a gate electrode for controlling electron emission from the electron-emissive elements, and a display screen for collecting the electrons; enabling the display screen to establish a voltage differential between the display screen and the electron-emissive elements; and following enabling of the display screen, enabling the gate electrode by delaying substantial electron emission from the electron-emissive elements until the voltage differential has been established to direct the electrons towards the display screen and to substantially prevent the electrons from striking the gate electrode.

Embodiments of the present invention further include a field emission display device comprising: a baseplate; a plurality of electron-emissive elements on the baseplate; a gate electrode on the baseplate for controlling electron emission from the electron-emissive elements; a display screen spaced from the baseplate and configured for collecting electrons emitted from the electron-emissive elements to generate an image thereon; and a control circuit configured to control a flow of electrons to the electron-emissive elements, the control circuit allowing a voltage differential to be established between the display screen and the electron-emissive elements prior to substantial electron emission from the electron-emissive elements to prevent substantial gate-to-emitter current during turn on of the field emission display device.

Another method embodiment used in conjunction with the field emission display device described above is used for equalizing readsorption of contaminant species, the method comprising the steps of: determining the angular distribution of the desorbed species; determining the anticipated accumulation of the desorbed species at the emitter.-sites; determining a time average current emission for each of the emitter sites wherein the time integrated flux of contaminant species is substantially the same at each of the emitter sites; and, driving each emitter site with the determined emission current.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

GENERAL DESCRIPTION OF FIELD EMISSION DISPLAYS

Figure 1:
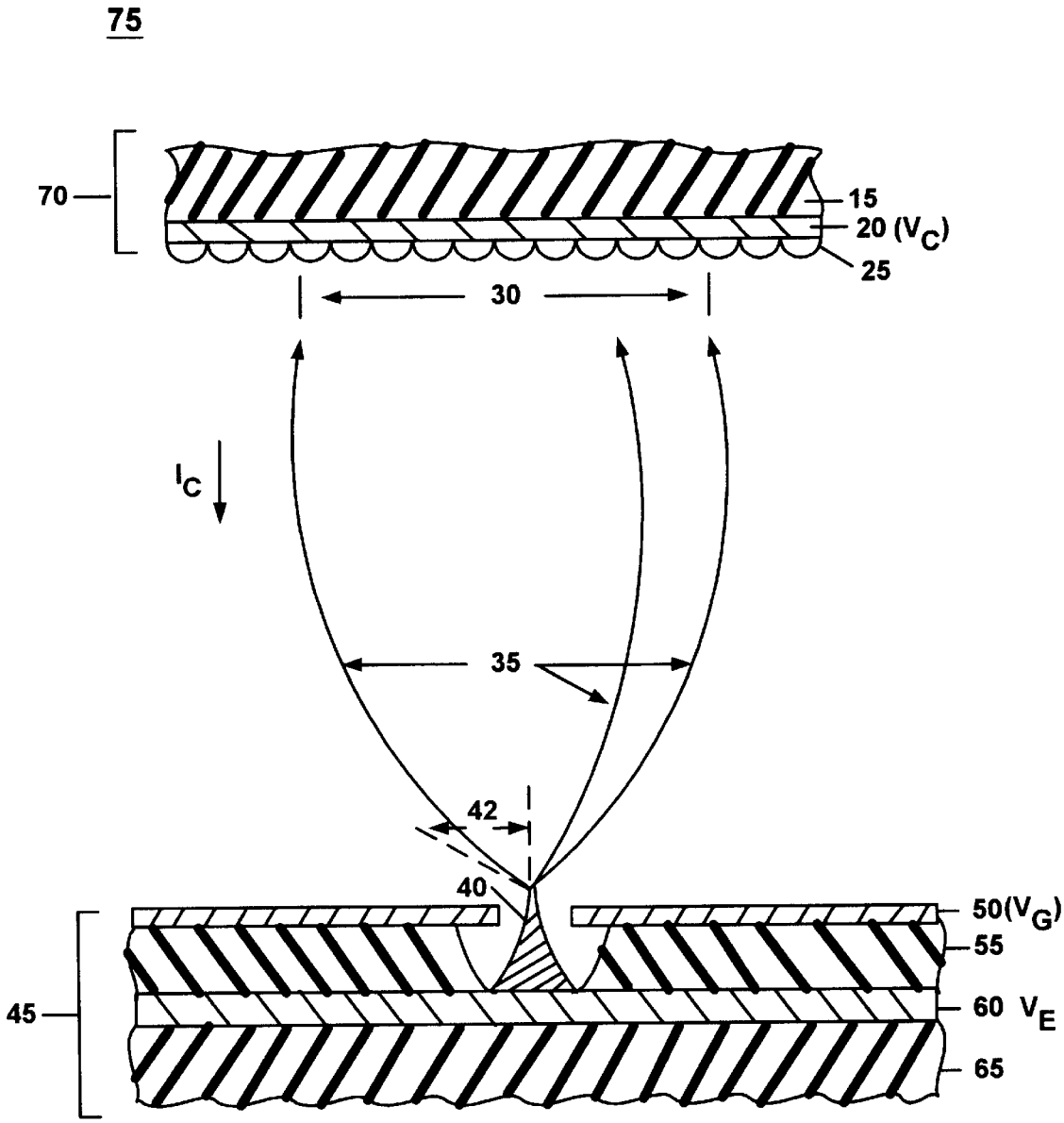
FIG. 1 is a cross section structural view of part of an exemplary flat panel FED screen that utilizes a gated field emitter situated at the intersection of a row line and a column line.

A general description of field emission displays is presented. FIG. 1 illustrates a multi-layer structure 75 which is a cross-sectional view of a portion of an FED flat panel display. The multi-layer structure 75 contains a field-emission backplate structure 45, also called a baseplate structure, and an electron-receiving faceplate structure 70. An image is generated at faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30. In one embodiment, electron emissive element 40 includes a conical molybdenum tip. In other embodiments of the present invention, the anode 20 may be positioned over the phosphors 25, and the emitter 40 may include other geometrical shapes such as a filament.

The emission of electrons from the electron-emissive element 40 is controlled by applying a suitable voltage ($V_G$) to the gate electrode 50. Another voltage ($V_E$) is applied directly to the electron-emissive element 40 by way of the emitter electrode 60. Electron emission increases as the gate-to-emitter voltage, e.g., $V_G$ minus $V_E$, or $V_{GE}$, is increased. Directing the electrons to the phosphor 25 is performed by applying a high voltage ($V_C$) to the anode 20. When a suitable gate-to-emitter voltage $V_{GE}$ is applied, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. Thus, $V_G$ and $V_E$ determine the magnitude of the emission current ($I_C$), while the anode voltage $V_C$ controls the direction of the electron trajectories for a given electron emitted at a given angle.

Figure 2:
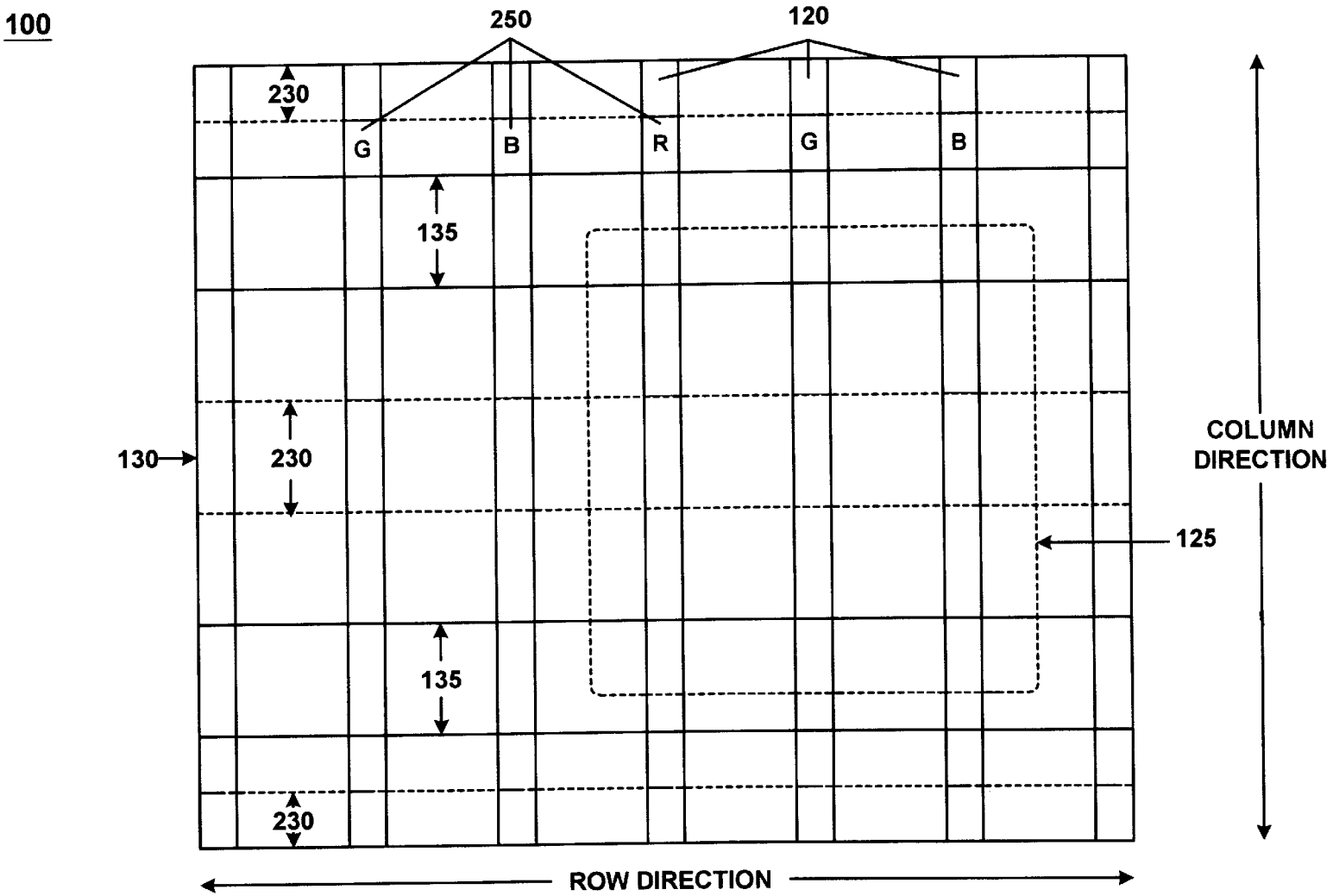
FIG. 2 illustrates an exemplary FED screen in accordance with one embodiment of the present invention.

FIG. 2 illustrates a portion of an exemplary FED screen 100. The FED screen 100 is subdivided into an array of horizontally aligned rows and vertically aligned columns of pixels. The boundaries of a respective pixel 125 are indicated by dashed lines. Three separate row lines 230 are shown. Each row line 230 is a row electrode for one of the rows of pixels in the array. In one embodiment, each row line 230 is coupled to the emitter cathodes of each emitter of the particular row associated with the electrode. A portion of one pixel row is indicated in FIG. 2 and is situated between a pair of adjacent spacer walls 135. In other embodiments, spacer walls 135 need not be between each row. And, in some displays, space walls 135 may not be present. A pixel row includes all of the pixels along one row line 230. Two or more pixel rows (and as much as 24–100 pixel rows), are generally located between each pair of adjacent spacer walls 135.

In color displays, each column of pixels has three column lines 250: (1) one for red; (2) a second for green; and (3) a third for blue. Likewise, each pixel column includes one of each phosphor stripes (red, green, blue), three stripes total. In a monochrome display, each column contains only one stripe. In the present embodiment, each of the column lines 250 is coupled to the gate electrode of each emitter structure of the associated column. Further, in the present embodiment, the column lines 250 for coupling to column driver circuits (not shown) and the row lines 230 are for coupling to row driver circuits (not shown).

In operation, the red, green and blue phosphor stripes are maintained at a high positive voltage relative to the voltage of the emitter-cathode 60/40. When one of the sets of electron-emission elements is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. The above FED configuration is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

FED CONDITIONING PROCEDURE ACCORDING TO ONE EMBODIMENT OF THE PRESENT INVENTION

The present invention provides for a process of conditioning newly fabricated FEDs to remove contaminant particles contained therein. The conditioning process is performed before the FED device is used in normal operations, and is typically performed during manufacturing. During the conditioning process of the present invention, contaminants contained in the vacuum tube of an FED are bombarded by a large amount of electrons. As a result of the bombardment, the contaminants will be knocked off and collected by a gas-trapping device (e.g., a getter). Because newly fabricated FEDs contain a large amount of contaminants, precautious steps must be taken to ensure that arcing does not occur during the conditioning process in accordance with the present invention. To this end, according to the present invention, the conditioning process includes the step of driving the anode to a predetermined high voltage and the step of enabling the emission cathode thereafter to ensure that the electrons are pulled to the anode. In furtherance of one embodiment of the present invention the emission current is slowly increased to the maximum value after the anode voltage has reached the predetermined high voltage.

Figure 3:
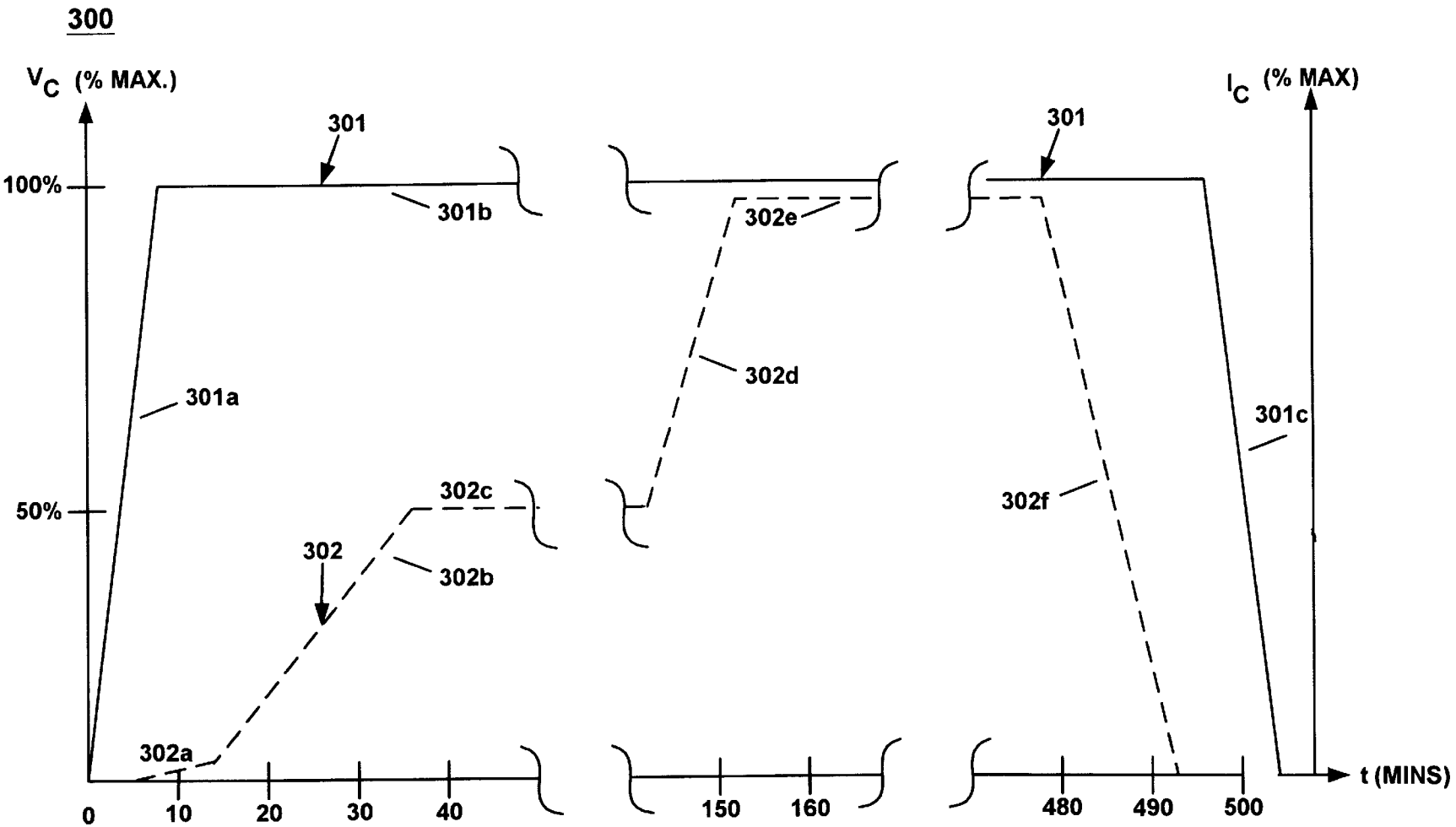
FIG. 3 illustrates a voltage and current application technique for turning-on an FED device according to one embodiment of the present invention.

FIG. 3 illustrates a plot 300 showing the changes in anode voltage level and emission current level of a particular FED during the conditioning process of the present embodiment. 10 Plot 301 illustrates the changes in anode voltage ($V_C$), and plot 302 illustrates the changes in emission current ($I_C$). Particularly, $V_C$ is represented as a percentage of a maximum anode voltage provided by the driver electronics. For instance, for a high voltage phosphor, a maximum anode voltage may be 3,000 volts. It should be noted that the maximum anode voltage may not be the normal operational voltage of the anode. For example, the normal operational voltage of the display screen may be 25% to 75% of the maximum anode voltage. $I_C$ is represented as a percentage of a maximum emission current provided by the driver circuits of the FED. Driver electronics and electronic equipment for providing high voltages and large currents to FEDs are well known in the art, and are therefore not discussed herein to avoid obscuring aspects of the present invention.

According to the present invention, plot 301 includes a voltage ramp segment 301*a*, a first level segment 301*b*, and a voltage drop segment 301*c*; and plot 302 includes a first current ramp segment 302*a*, a second current ramp segment 302*b*, a second level segment 302*c*, a third current ramp segment 302*d*, a third level segment 302*e*, and a current drop segment 302*f*. In the particular embodiment as shown, in the voltage ramp segment 301*a*, $V_C$ increases from 0% to 100% of the maximum anode voltage over a period of approximately 5 minutes. Significantly, $I_C$ remains at 0% as $V_C$ increases to ensure that the electrons are pulled towards the display screen (anode) instead of the gate electrodes.

After $V_C$ has reached 100% of the maximum anode voltage, $V_C$ is maintained at that voltage level for roughly 25 minutes. Contemporaneously, $I_C$ is slowly increased from 0% to 1% of the maximum emission current over approximately 10 minutes (first current ramp segment 302*a*). Thereafter, $I_C$ is slowly increased to 50% of the maximum emission current over approximately 20 minutes (second current ramp segment 302*b*). $I_C$ is then maintained at the 50% level for roughly 10 minutes (third level segment 302*c*). According to the present invention, $I_C$ is increased at a slow rate to avoid the formation of high ionic pressure zones formed by desorption from the electron emitters. Desorbed molecules may form small zones of high ionic pressure, which may increase the risk of arcing. Thus, by slowly increasing the emission current, the occurrence of arcing is significantly reduced.

According to FIG. 3, $I_C$ is then maintained at a constant level for approximately 10 minutes (third level segment 302*c*) for "soaking" occur. Soaking refers to the process by which contaminant particles are removed by gas-trapping devices. Gas-trapping devices, generally known as "getters," are used by the present invention at this stage of the conditioning process and are well known in the art.

In one embodiment, after the soaking period, $I_C$ is then subsequently increased to 100% of its maximum level (third current ramp 302*d*) and, thereafter, remained at that level for approximately 2 hours (fourth level segment 302*e*). Contemporaneously, $V_C$ is maintained at its maximum level. Thereafter, $V_C$ and $I_C$ are then subsequently brought back to 0% of their respective maximum values. Significantly, as illustrated by segments 302f and 301c of FIG. 3, $I_C$ is turned off before $V_C$ is turned off. In this way, it is ensured that all emitted electrons are pulled towards the display screen (anode) and that gate-to-emitter currents are prevented.

During the conditioning process of the present invention, any knocked off or otherwise released contaminants are collected by gas-trapping devices, otherwise known as "getters." Getters, as discussed above, are well known in the art. In the particular embodiment as illustrated in FIG. 3, the total conditioning period is roughly six hours. After this conditioning period, most of the contaminants would have been knocked off and collected by the getters, and the newly fabricated FED screen would be ready for normal operation.

Figure 4:
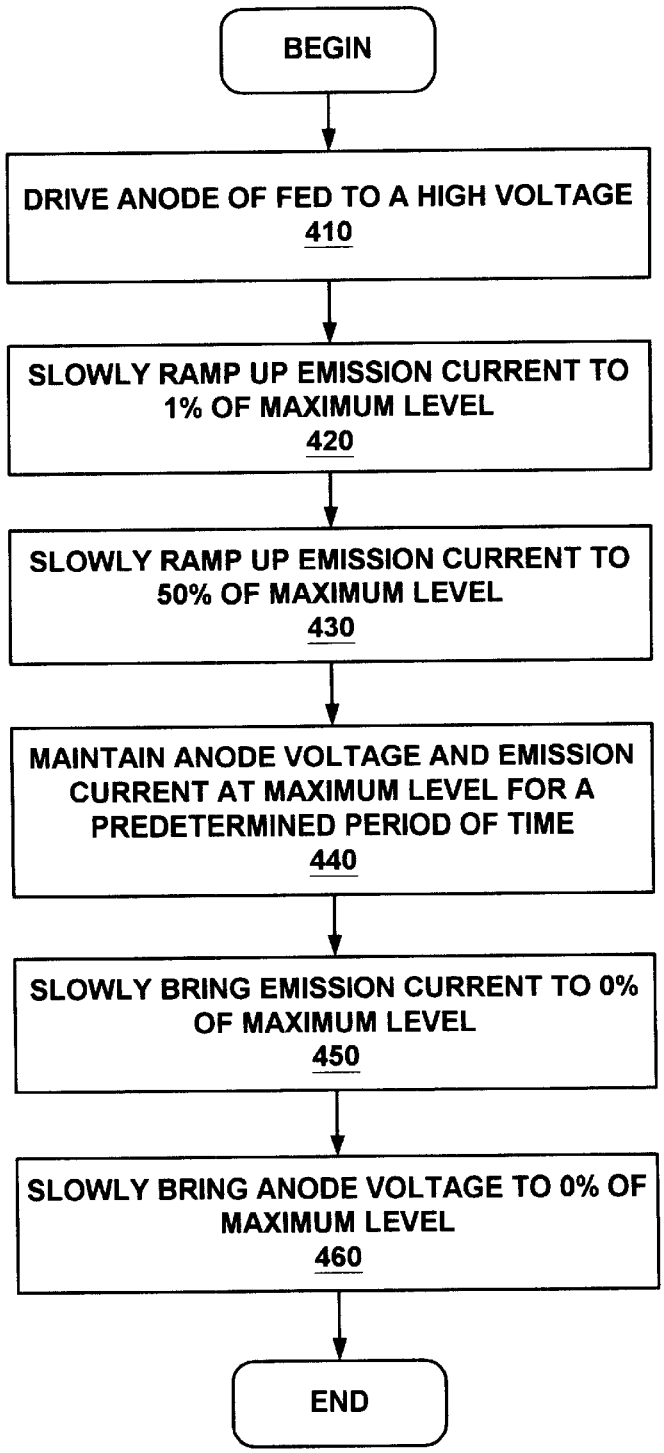
FIG. 4 illustrates a flow diagram of the steps of an FED conditioning process according to one embodiment of the present invention.

FIG. 4 is a flow diagram 400 illustrating steps of the FED conditioning process according to the present invention. To facilitate the discussion of the present invention, flow diagram 400 is described in conjunction with exemplary FED structure 75 illustrated in FIG. 1. With reference now to FIGS. 1 and 4, at step 410, the anode 20 of the FED is driven to a high voltage. It should be noted that, at step 410, the emission current ($I_C$) is maintained at 0% of the maximum level, and is therefore off. In one embodiment of the present invention, the voltage of the gate electrode 50 and the emitter-cathode 60/40 are maintained at ground. The anode voltage is driven to a high voltage while maintaining an emission current at 0% to ensure that the electrons, once emitted, are pulled to the anode 20 rather than the gate electrode 50.

At step 420 of FIG. 4, the emission current $I_C$ is slowly increased to 1% of a maximum emission current provided by driver electronics of the FED. In one particular embodiment of the present invention, step 420 takes roughly 5 minutes to accomplish. The slow ramp up ensures that localized zones of high ionic pressure will not be formed by desorption from the electron emitters. Further, in the present embodiment, the emission current $I_C$ is proportional to the square of the gate-to-emitter voltage ($V_{GE}$) as predicted by the Fowler-Nordheim theory. Thus, in the present embodiment, the emission current $I_C$ may be controlled by adjusting the gate-to-emitter voltage $V_{GE}$.

At step 430 of FIG. 4, the emission current $I_C$ is ramped up to approximately 50% of the maximum emission current provided by driver electronics of the FED. In one embodiment, step 430 takes roughly 10 minutes to accomplish. As in step 420, the slow ramp up allows ample time for desorbed molecules to diffuse away, and ensures that localized zones of high ionic pressure are not formed.

At step 440 of FIG. 4, emission current $I_C$ and anode voltage $V_C$ are maintained at 100% of their respective maximum values such that a large amount of electrons will be emitted. The emitted electrons will bombard and knock off most loose contaminants unremoved by previous fabricating processes. The knocked off contaminants are subsequently trapped by ion-trapping devices such as the getters. As discussed above, getters are well known in the art, and are therefore not described herein to avoid obscuring aspects of the invention.

At step 450, the emission current is brought to 0% of the maximum value. Subsequently, at step 460, the anode voltage is brought to 0% of its maximum value. It is important to note that emission current is turned-off prior to turning-off the anode voltage such that all emitted electrons will be attracted to the anode. Thereafter, the conditioning process 400 ends.

Figure 5:
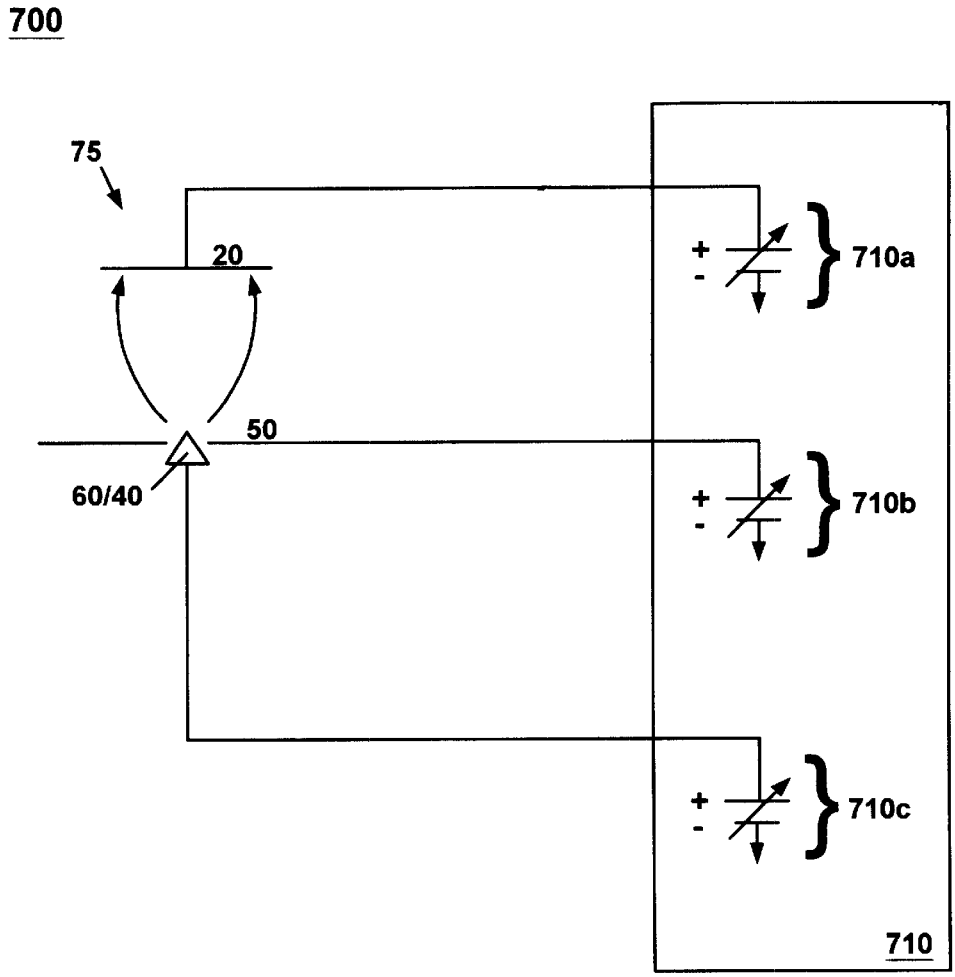
FIG. 5 illustrates a block diagram of a system for conditioning an FED according to one embodiment of the present invention.

FIG. 5 is a block diagram 700 illustrating an apparatus for controlling the conditioning process according to one embodiment of the present invention. A simplified diagram of the FED 75 of FIG. 1 is also illustrated. With reference to FIG. 5, the apparatus includes a controller circuit 710 configured for coupling to FED 75. Particularly, controller circuit 710 includes a first voltage control circuit 710*a* for providing an anode voltage to anode 20 of FED 75. Controller circuit 710 further includes a second voltage control circuit 710*b* for providing a gate voltage to gate electrode 50, and third voltage control circuit 710*c* for providing a emitter voltage to emitter cathode 60/40. It should be appreciated that the controller circuit 710 is exemplary, and that many different implementations of the controller circuit 710 may also be used.

In operation, the voltage control circuits 710*a–c* provide various voltages to the anode 20, gate electrode 50 and emitter electrode 60/40 of the FED 75 to provide for different voltages and emission current during the conditioning process of the present invention. In one embodiment of the present invention, the controller circuit 710 is a stand alone electronic equipment specially made for the present conditioning process to provide very high voltages. However, it should be appreciated that controller circuit 710 may also be implemented within an FED to control the anode voltage and emission currents during turn-on and turn-off of the FED.

FED TURN-ON AND TURN-OFF PROCEDURES OF THE PRESENT INVENTION

The present invention also provides for a method of operating a field emission display to minimize the risk of arcing during power-on and power-off of the FED unit. Particularly, according to one embodiment of the present invention, the method of operating an FED includes the steps of: turning on the anodic display screen of the FED, and, thereafter, turning on the emission cathodes. According to another embodiment of the present invention, the method of operating an FED to minimize the risk of arcing includes the steps of: turning off the emission cathodes, and thereafter, turning-off the anodic display screen. According to the present invention, the occurrence of arcing is substantially reduced by following the-aforementioned steps.

Figure 6:
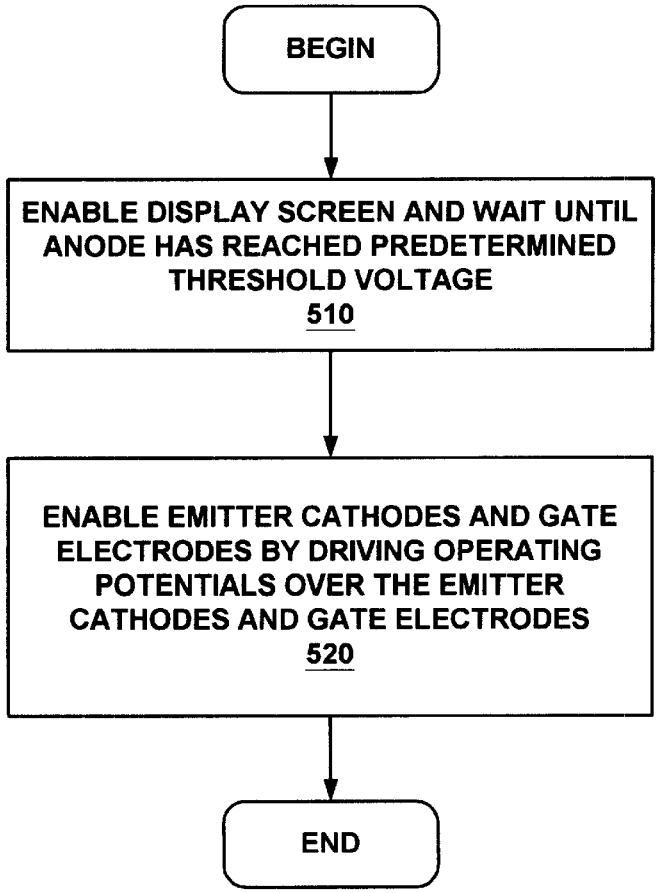
FIG. 6 illustrates a flow diagram of the steps of an FED turn-on procedure according to another embodiment of the present invention.

FIG. 6 illustrates a flow diagram 500 of steps within an FED turn-on procedure according to another embodiment of the present invention. In order to facilitate the discussion of the present invention, flow diagram 500 is described in conjunction with exemplary FED 75 of FIG. 1. With reference now to FIGS. 1 and 6, at step 510, when the FED 75 is switched on, the anode 20 is enabled. In the present embodiment, the anode is enabled by the application of a predetermined threshold voltage (e.g. 300 V). Further, in the present invention, the anode may be enabled by switching on a power supply circuit (not shown) that supplies power to the anode 20. Power supplies for FEDs are well known in the art, and any number of well know power supply devices can be used with the present invention.

At step 520, after the anode 20 of the FED 75 is enabled, and after the anode has reached the predetermined threshold voltage, the emitter cathode 60/40 and the gate electrode 50 of the FED 75 are then enabled. In the present invention, the emitter cathode 60/40 of the FED 75 is enabled a predetermined period after the anode 20 has been enabled to direct the electrons towards the anode 20 and to prevent the electrons from striking the gate electrode 50. In one embodiment, the emitter cathode 60/40 and the gate electrode 50 may be enabled by switching on the row and column driver circuits (not shown) of the FED.

Figure 7:
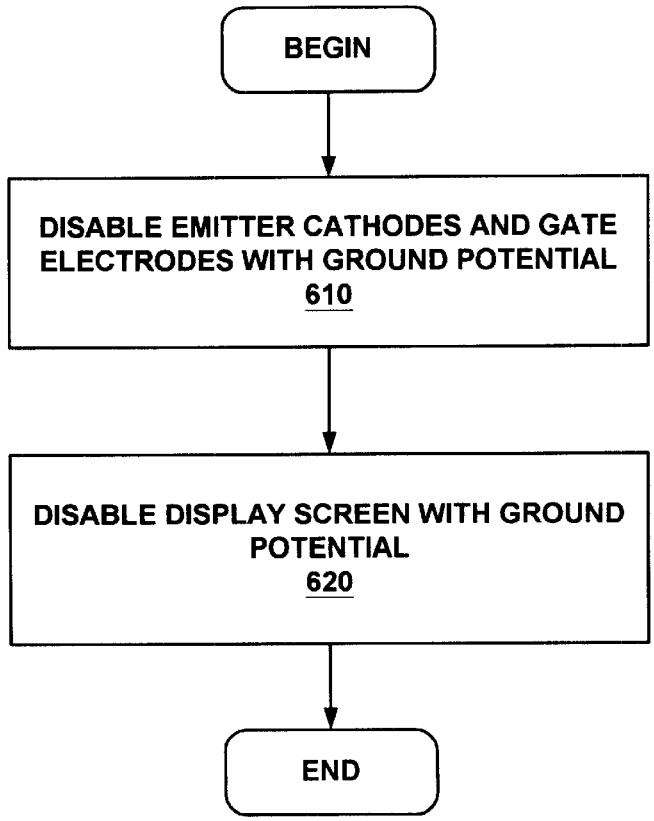
FIG. 7 illustrates a flow diagram of the steps of an FED turn-off procedure according to another embodiment of the present invention.

FIG. 7 is a flow diagram 600 illustrating steps of an FED turn-off procedure according to another embodiment of the present invention. In the following, flow diagram 600 is discussed in conjunction with exemplary FED 75 of FIG. 1. With reference now to FIG. 1 and 7, at step 610, when the FED is switched off, the emitter cathode 60/40 and the gate electrode 50 of the FED 75 are disabled. Contemporaneously, the anode 20 remains at a high voltage. Further, in one embodiment, the emitter cathode 60/40 and gate electrode 50 are disabled by setting the row voltages and column voltages respectively provided by row drivers and column drivers (not shown) to a ground potential.

At step 620, after the emitter cathode 60/40 and the gate electrode 50 are disabled, the anode 20 of the FED is disabled. According to the present invention, step 620 is performed after step 610 in order to ensure that all electrons emitted from emission cathodes will be attracted to the anodic display screen. In one embodiment, the anode 20 is disabled by switching off the power supply circuit (not shown) that supplies power to the anode 20. In this way, the occurrence of arcing in FEDs is minimized.

FED CONDITIONING PROCESS ACCORDING TO ANOTHER EMBODIMENT OF THE INVENTION

Figure 8:
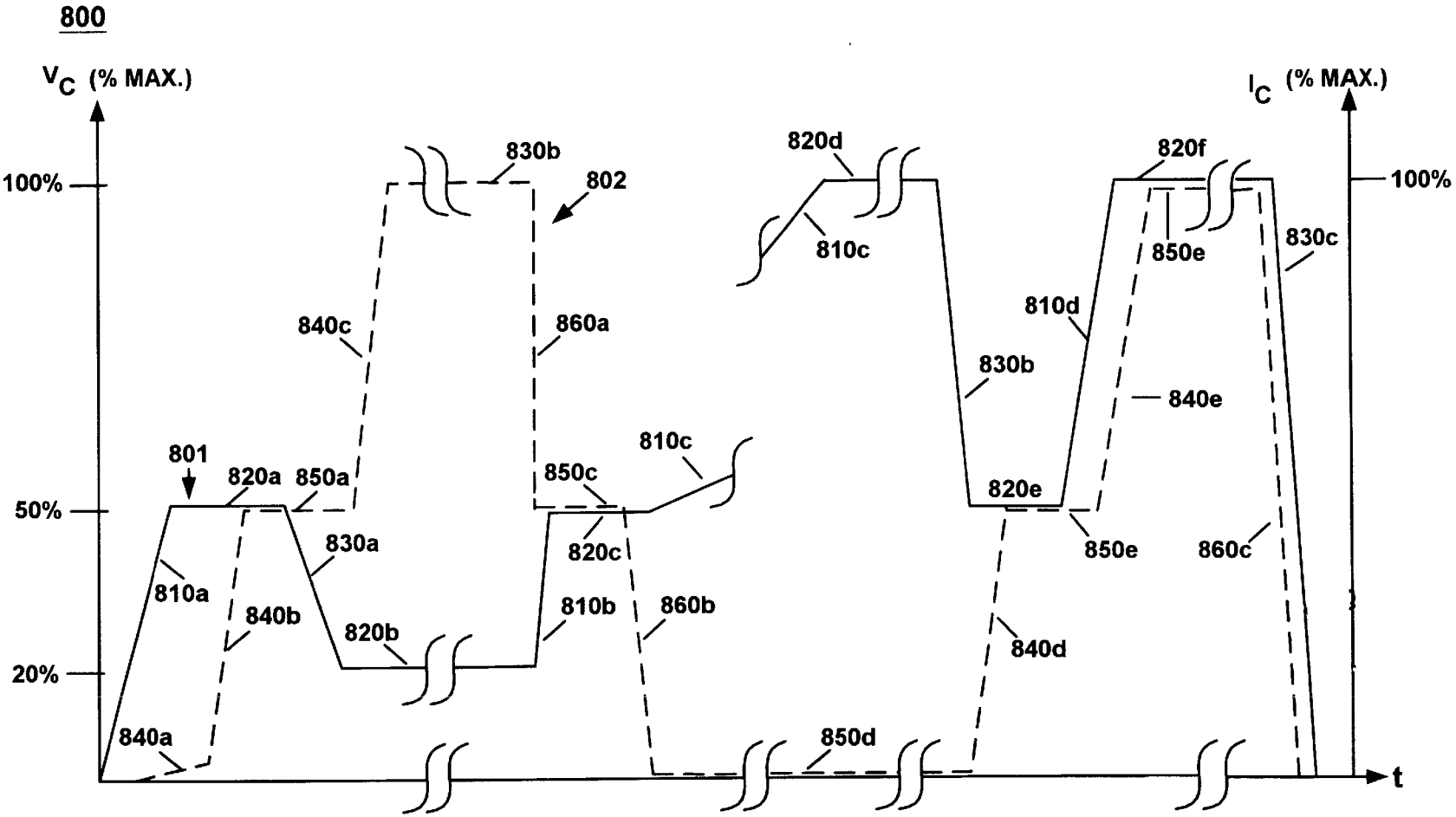
FIG. 8 illustrates a voltage and current application technique for turning-on an FED device according to another embodiment of the present invention.

FIG. 8 is a plot 800 illustrating a voltage and current application technique for conditioning a particular FED device according to another embodiment of the present invention. Plot 801 illustrates the changes in anode voltage ($V_C$), and plot 802 illustrates the changes in emission current ($I_C$). Particularly, $V_C$ is represented as a percentage of a maximum anode voltage provided by the driver electronics. $I_C$ is represented as a percentage of a maximum emission current provided by the driver circuits of the FED.

According to the present invention, plot 801 includes voltage ramp segments 810*a–d*, constant voltage segments 820*a–f*, voltage drop segments 830*a–c*; and plot 302 includes current ramp segments 840*a–e*, constant current segments 850*a–e*, and current drop segments 860*a–c*. In the particular embodiment as shown, in the voltage ramp segment 810*a*, $V_C$ increases from 0% to 50% of the maximum anode voltage over a period of approximately 10 minutes. Significantly, $I_C$ remains at 0% as $V_C$ increases to ensure that the electrons are pulled towards the display screen (anode) instead of the gate electrodes.

After $V_C$ has reached 50% of the maximum anode voltage, $V_C$ is maintained at that voltage level for roughly 30 minutes (constant voltage segment 820*a*). Contemporaneously, $I_C$ is slowly increased from 0% to 1% of the maximum emission current over approximately 10 minutes (current ramp segment 840*a*). Thereafter, $I_C$ is slowly increased to 50% of the maximum emission current over approximately 10 minutes (current ramp segment 840*b*). $I_C$ is then maintained at the 50% level for roughly 10 minutes (constant current segment 850*a*). According to the present invention, $I_C$ is increased at a slow rate to avoid the formation of high ionic pressure zones formed by desorption from the electron emitters. Desorbed molecules may form small zones of high ionic pressure, which may increase the risk of arcing. By slowly increasing the emission current, ample time is allowed for the desorbed molecules may diffuse to gas-trapping devices (e.g., getters). In this way, occurrence of arcing is significantly reduced.

According to FIG. 8, $V_C$ is reduced from 50% to 20% level (voltage drop segment 830*a*) and is maintained at the 20% level for roughly 30 minutes (constant voltage segment 820*b*). After $V_C$ has reached the 20% level, $I_C$ is slowly ramped up to the 100% level (current ramp segment 840*c*). It should be noted that the 20% level is selected such that the anode voltage is close to a minimum threshold level for the anode of the FED to attract the emitted electrons. $I_C$ is then maintained at a constant level for approximately 20 minutes (constant current segment 820*b*) for "soaking" occur.

In the present embodiment, $I_C$ is then subsequently decreased to 50% of its maximum level (current drop segment 860*a*) and, thereafter, remained at that level for approximately 20 minutes (constant current segment 850*c*). After $I_C$ has reached the 50% level, $V_C$ is increased to the 50% level (voltage ramp segment 810*b*) and is maintained at that level for 20 minutes (constant current level 820*c*). Thereafter, $I_C$ is turned-off to 0% of its maximum value (current drop segment 860*b*).

After $I_C$ is turned off, $V_C$ is slowly ramped up to 100% of its maximum level over a period of approximately 2.5 hours (voltage ramp segment 810*c*), and is maintained at the maximum level for approximately 1 hour (constant voltage segment 820*d*). Thereafter, $V_C$ is decreased to the 50% level (voltage drop segment 830*b*), and is maintained at that level for approximately 20 minutes (constant voltage segment 820*e*). $I_C$ is slowly increased from 0% to the 50% level (current ramp 840*d*) when $V_C$ is at 50% level. $V_C$ and $I_C$ are then subsequently driven to 100% of their respective maximum values (voltage ramp segment 810*d* and current ramp segment 840*e*), and are maintained at those levels for approximately 1.5 hours (constant voltage segment 820*f* and constant current segment 850*e*). Thereafter, $V_C$ and $I_C$ are brought back to 0% (voltage drop segment 830*c* and current drop segment 860*c*).

Significantly, as illustrated by segments 810*d* and 840*e* of FIG. 8, $I_C$ is driven to the maximum value after $V_C$ is driven to the maximum value, and $I_C$ is turned off before $V_C$ is turned off. In this way, it is ensured that all emitted electrons are pulled towards the display screen (anode) and that gate-to-emitter currents are prevented.

Figure 9A:
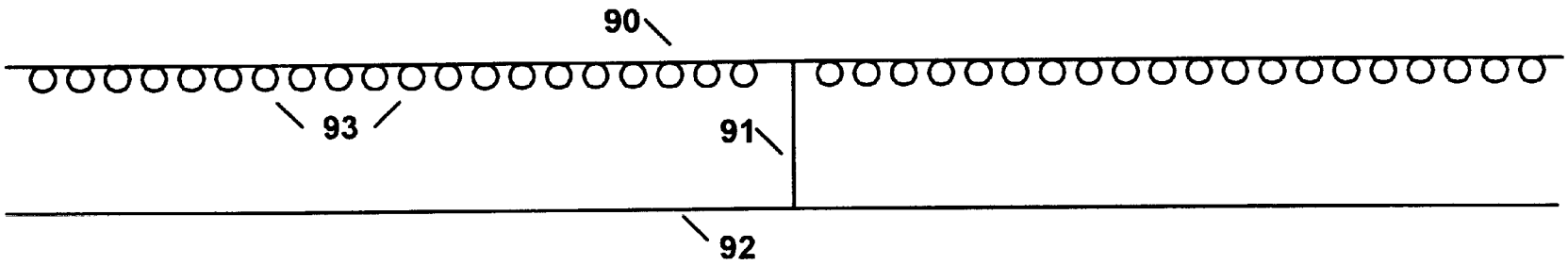
FIGS. 9A and 9B illustrate a nonuniform readsorption resulting from a uniform desorption.

FIG. 9A shows a schematic representation in elevation cross-section of an initial uniform distribution of contaminant species in an FED. Before conditioning, in general, the contaminant species 93 may be uniformly distributed on the surface of the faceplate 90. The faceplate 90 is separated from the upper plane of the gate surface 92 by a spacer wall 91.

Figure 9B:
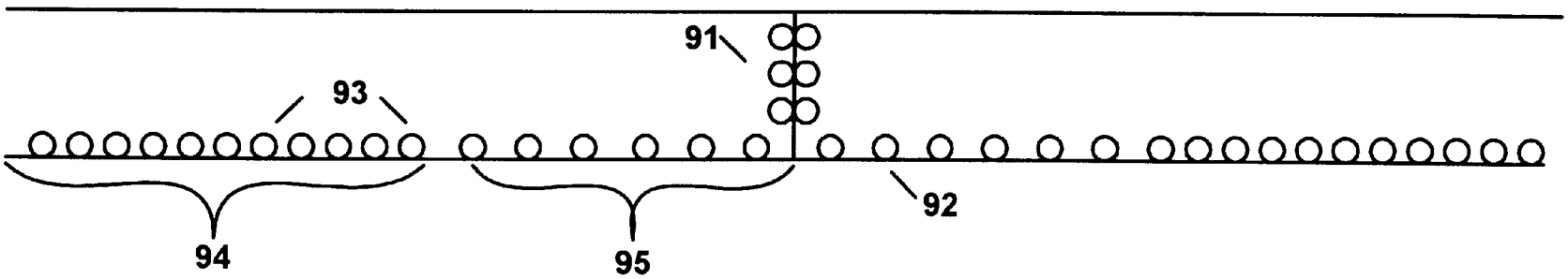

FIG. 9B shows the distribution of the readsorbed contaminant species after they have been removed from the faceplate through electron induced desorption by a uniform emitter current. Close to the spacer wall 91 there is a low-density region 95 on the gate surface 92. The low density is caused by the additional surface area for readsorption that is provided by the spacer wall 91. At some distance from the wall, there is a uniform density region 94 that is unaffected by the presence of the spacer wall 91. For FEDs that have a relative large ratio between the separation between spacer walls and the spacer wall height, the uniform density region 94 will include most of the gate surface.

The emitters located the uniform density region 94 will be uniformly affected by the readsorbed contaminant species 93; however, emitters located in the low-density region 95 will have a different contamination level than the emitters in the uniform density region 94, and hence will have emission characteristics different from the emitters in the uniform density region 94 when the contaminant species change the work function of the emitter surface. This change in work function may produce a lightening or darkening of the display that is correlated with the spacer walls (e.g., banding).

Figure 10:
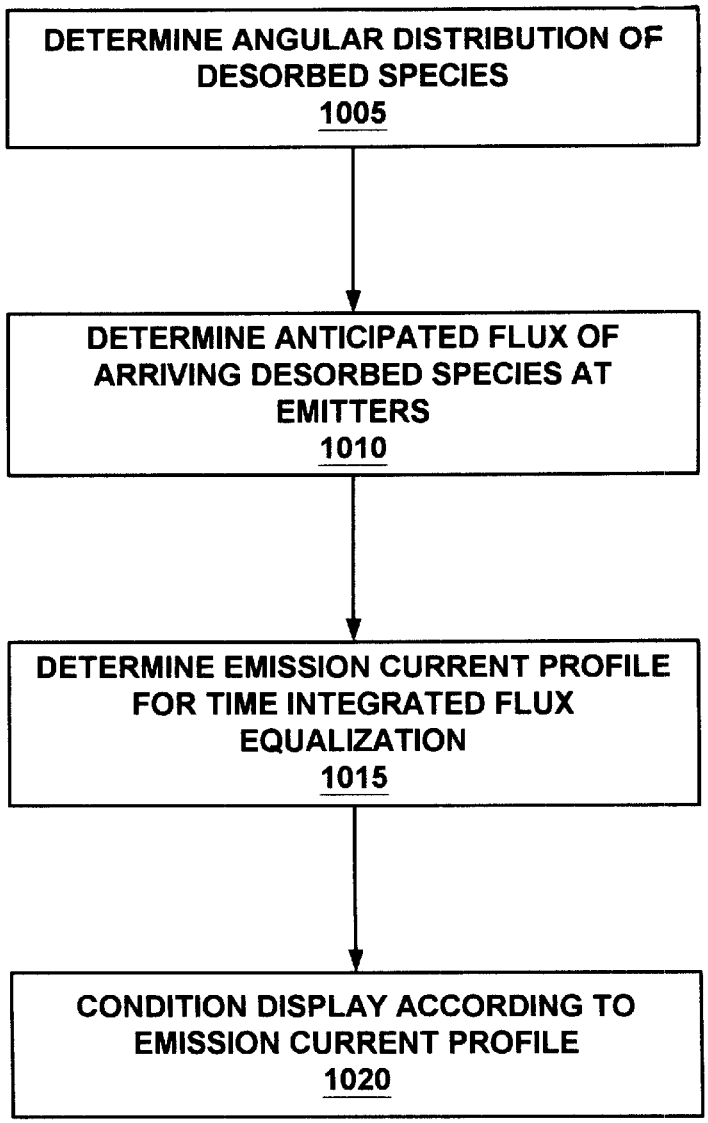
FIG. 10 illustrates a flow diagram for equalizing coverage by desorbed species in accordance with an embodiment of the present invention.

FIG. 10 shows a flow diagram for a method embodiment for equalizing the distribution of readsorbed species resulting from the electron induced desorption of contaminants by the emitter current during conditioning of an FED.

In step 1005, the angular distribution of desorbed species leaving the faceplate surface is determined. This may be done empirically, or by an analytical model. Typically, the flux density will be greatest normal to the faceplate and smallest at low angles to the faceplate.

In step 1010, the total anticipated flux arriving at each pixel of the cathode is determined by summing the flux arriving from all of the pixels on the faceplate. The flux arriving from a given pixel will be determined by angular distribution characteristic, the incident energy, and shadowing. The trajectory of the desorbed species is assumed to be ballistic with no scattering. If the incident energy is assumed to be constant across the face plate, the total anticipated flux values for the cathode pixels may be calculated and stored in a matrix. Alternatively, system of N equations with N unknowns may be established wherein N equals the number of pixels and the flux is assumed to be the same at each of the cathode pixels. The unknown to be solved for in the system of equations is then the incident current.

In step 1015, the time average current required at each cathode in order to achieve a uniform flux across the cathode is determined. This may be done by adjusting values that might produce singularities or other physically irregular results, and inverting the matrix created in step 1010. The desorbed flux from the faceplate is directly dependent upon the incident current. The inverted matrix provides weighting factors that can be used to provide an energy emission profile on a pixel-by-pixel basis so that the net flux is uniform. Alternatively, the system of N equations and N unknowns may be solved using an iterative technique. In either case, the solution provides the relative values for energy emission required at the emitters for equalized distribution of the desorbed species.

Since the wall spacers are parallel to the pixel rows, the adjustment to the emission energy may be done on effectively on a row-by-row basis. By taking advantage of the display row symmetry, the calculations may be simplified considerably. It should also be noted that the overall display symmetry also offers the simplification of making the calculations on a single display segment (a display segment being defined as the region between two spacer walls) if the spacer walls have a constant spacing across the display.

In step 1020, the display is conditioned using the emission current profile (e.g. weighted emission currents) derived in step 1015. The conditioning may be done with steady state values, but is preferably done by using time averaged values obtained by driving the display using a conventional sequential row/column addressing scheme, wherein each pixel is driven with the same current but the duty cycle is allowed to vary. The emission current levels and duty cycle are selected so that the time integrated flux of the contaminant species is essentially the same at each of the emitter sites.

The contaminant equalization may be combined with the previously described conditioning procedures for preventing arcing. In general the earlier phase of the conditioning process will emphasize the reduction of arcing, whereas the later phase will have an increased emphasis on contaminant distribution. Since the contaminant equalization is dependent upon emission current ratios integrated over time, the absolute emission current of any emitter may be varied over time by a duty cycle and/or a ramp.

It should be noted that the efficacy of using a current emission profile to produce a uniform desorbed flux of contaminants at the emitters is dependent upon the mobility of the contaminants on the faceplate surface. In order to achieve equalization, the emitters near the spacer walls are driven harder on average, than the emitters farther away from the spacer walls. In order for the increased emission near the spacer walls to increase the time integrated flux near the spacer walls, the contaminant species must be able to migrate to pixels near the spacer walls.

The faceplate 90 may have a coating selected such that the anticipated contaminant species will have a sufficiently high surface mobility to enable migration of "replacement" species toward the spacer walls as species near the spacer walls are desorbed. It is desirable that the mobility of a contaminant species be sufficiently high on the faceplate surface to enable replacement migration. Typically the anticipated contaminant species will be determined on the basis of initial concentrations and getter affinity. A "worst case" contaminant would be one that has a high initial concentration, low getter affinity, and a significant influence on emitter surface work function. In a display that has methane as a dominant contaminant, it is desirable that the faceplate surface has a coating upon which methane is mobile. In general, the dominant contaminant species is the species that is produced in the greatest number from the faceplate during electron bombardment. The dominant contaminant is frequently an organic compound.

Thus, the FED can be viewed as a system that can have several structural and operational elements tuned to optimize conditioning. From a manufacturing standpoint, it is desirable to condition a device quickly and with a robust process. An example of such a method is to turn off pixels I the rows away from the wall during a certain percentage of the vertical refresh frames. In this scheme the pixels in each row are run at a duty cycle which determines the average emitted current.

Figure 11A:
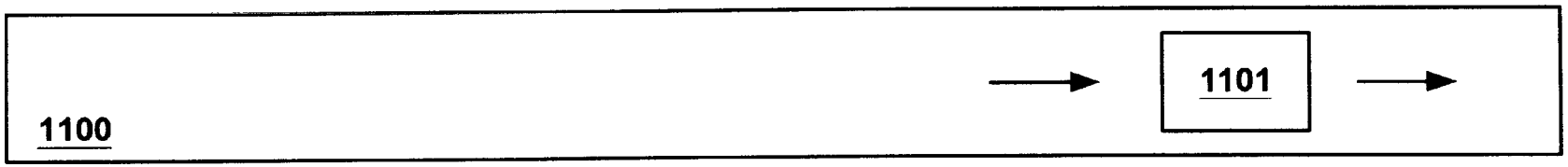
FIGS. 11A, 11B, and 11C illustrate a display pattern for constant current conditioning in accordance with an embodiment of the present invention.

FIG. 11A shows a display segment 1100 made up of a region between two spacer walls. The display segment is driven by an image generation device so that it appears that a dark rectangle 1101 is moving from left to right against a light background. It should be noted that rectangle 1101 does not extend entirely across the display segment 1100. As the rectangle traverses the display segment, the pixels away from the spacer walls are dark, whereas the pixels close to the spacer wall remain illuminated.

Figure 11B:
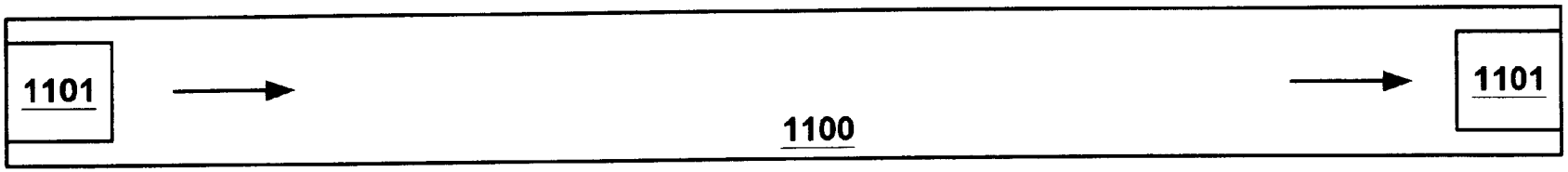

FIG. 11B shows the rectangle 1101 "wrapping around" the display segment 1100. The "wrapping around" behavior provides for a constant dark area and a constant illuminated area, thus providing a constant average current demand by the display segment.

Figure 11C:
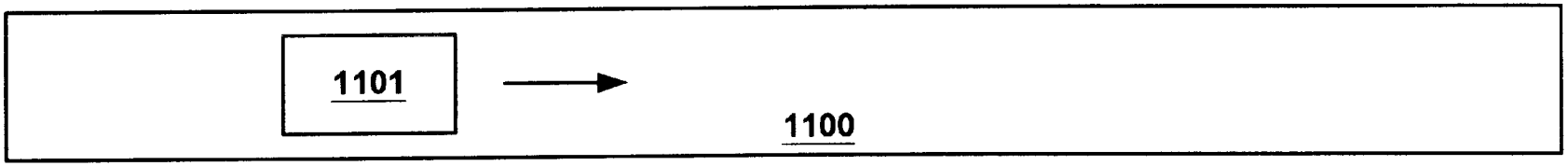

FIG. 11C shows the rectangle 1101 after completing a "wrap around" and in the process of making another traverse. This basic animation process is applied to all display segments in order to condition the cathode pixels on a row-by-row basis. The height and width of the rectangle determine which pixels are going to be turned off and for how long they will be turned off. Alternatively, the rectangle may be replaced by another image (e.g., an ellipse or a diamond) that has nonuniform width, thus providing a variable on/off ratio for pixels as a function of distance from the wall. These images are referred to collectively as a contrast image, and the conditioning for the display may be done by using an animated contrast image by using the traverse described above.

By driving a display with an image made up of rectangles (or other shape) traversing each display segment between spacers, an animated overall display image may be produced that is easily inspected (e.g., a vertical bar making one horizontal traverse per second). Since the conditioning period can be on the order of hours, it is likely that many devices will be conditioned in parallel, and it is desirable that a check for proper conditioning function of a device be made at a glance.

Figure 12:
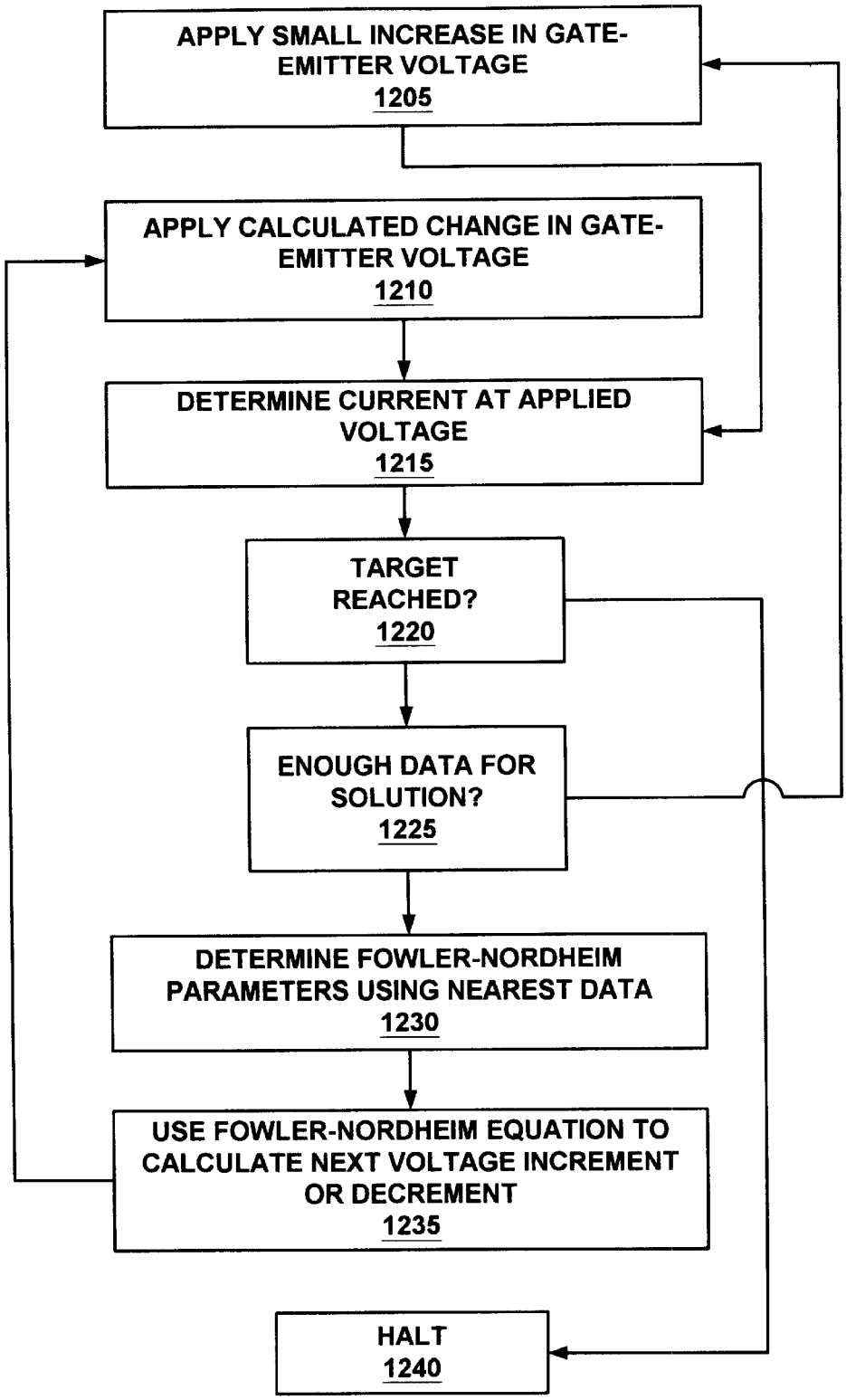
FIG. 12 illustrates a flow diagram for providing a feedback controlled ramp for the emission current in accordance with an embodiment of the present invention.

FIG. 12 illustrates a flow diagram for providing a feedback controlled ramp for the emission current in accordance with an embodiment of the present invention. As previously mentioned, the relationship between the emission current $I_C$ and the gate-to-emitter voltage $V_{GE}$ is described by the Fowler-Nordheim equation:

$$I=(V_{GE})^2 a \exp^{[-b/V]}.$$

Referring back to FIG. 4 and FIG. 8, it can be seen that the conditioning process may include several linear ramp segments for the emission current versus time. As can be seen from the Fowler-Nordheim equation, the relationship between the emission current $I_C$ and the gate-to-emitter voltage $V_{GE}$ is highly nonlinear.

Computer controlled test equipment typically calculates a binary value that is converted to an analog output, and thus does not provide a truly continuous output. Any change in a test parameter such as $V_{GE}$ is no made continuously over time, but periodically with small increments. A flow diagram for obtaining a smooth ramp for $I_C$ based upon computer controlled application of $V_{GE}$ is shown in FIG. 12.

In step 1205, a small increase is made in $V_{GE}$. When voltage is first applied to the gate, a level is selected that is known to be safely below the emission threshold to prevent damage. The first increase is kept small since no current measurements have been made that allow characterization of the emitter.

In step 1215, the current associated with the applied voltage is measured. This measurement may be made from a single point measurement, or averaged from a number of measurements taken over a period of time at a rate selected to cancel system noise.

In step 1220 a check is made to see if the desired current has been reached. If the current has been reached, the process halts at step 1240. If the desired current has not been reached, the process is continued at step 1225.

In step 1225, a check is made to see if there is enough data to compute a solution for the next voltage step. A minimum of two data points is required to determine the parameters a and b in the Fowler-Nordheim equation by "exact" solution. Due to noise and error, it is preferable to use more than two data points if they are available and perform a regression or curve fit to determine the parameters. It is also preferable that the most recently taken data be used.

In step 1230, the parameters for the Fowler-Nordheim equation are determined using the nearest data (e.g., the most recent data). Two or more data pairs may be used, as described above with the possible exclusion of data that is outside of a preset allowable range.

In step 1235, the value of $V_{GE}$ required for the desired level of $I_C$ is determined from the Fowler-Nordheim equation using the recently determined parameters.

In step 1235 a check is made to see if the desired current has been reached. If the current level has been reached, the process is halted at step 1240. If the desired current has not been reached, the process is continued at step 1210.

Depending upon the desired ramp and the overall system response, the voltage may change monotonically with each adjustment, or oscillate to some degree. The latter case will apply when small changes are made over short periods.

The present invention, a method of conditioning an FED to achieve a uniform distribution of contaminants has thus been disclosed. It should be appreciated that electronic circuits for implementing the present invention, particularly the circuits for delaying the activation of the emissive cathode until a threshold voltage potential has been established, are well known. For instance, it should be apparent to those of ordinary skill in the art, upon reading the present disclosure, that a control circuit responsive to electronic control signals may be used to sense the anode voltage and to turn on the power supply to the row and column drivers after the anode voltage has reached a threshold value. It should also be appreciated that, while the present invention has been described in particular embodiments, the present invention should not be construed as limited by such embodiments, but rather construed according to the below claims.

What is claimed is:

1. In a field emission display device, a method of equalizing readsorption at emitter sites of contaminant species desorbed from a faceplate comprising steps of:

determining a time average current for each of the emitter sites, wherein the time integrated flux of contaminant species is substantially the same at each of the emitter sites; and, driving each emitter site with the determined time average current.

2. The method of claim 1, further including determining the angular distribution of the desorbed species and determining the resulting accumulation of the desorbed species at the emitter sites.

3. The method of claim 1, further including controlling the time average current by controlling the instantaneous emission current.

4. The method of claim 1, wherein the each emitter is driven with a constant instantaneous current.

5. The method of claim 1, wherein the driving of each emitter site is performed in conjunction with an animated contrast image displayed on said display.

6. The method of claim 1, wherein the driving of each emitter site is done with a constant current for the field emission display device as a whole.

7. The method of claim 1, wherein the time average current is controlled using a duty cycle applied to each emitter.

8. The method of claim 4, wherein each row of pixels is driven in turn.

9. A field emission display device comprising:

a plurality of contaminant species;

a plurality of emitters; and a faceplate having a surface upon which at least one of said contaminant species has a sufficiently high mobility thereon to provide replacement migration.

10. The field emission display of claim 9, wherein said surface upon which at least one of said contaminant species has a sufficiently high mobility thereon to provide replacement migration, is provided by an applied coating.

11. The field emission display of claim 10 wherein said contaminant species increases the work function at the surface of the emitters.

12. The field emission display of claim 10 wherein said contaminant species decreases the work function at the surface of the emitters.

13. The field emission display of claim 10, further including a getter.

14. The field emission display of claim 13, wherein the contaminant species having the lowest getter affinity has sufficiently high mobility on said surface to provide replacement migration.

15. The field emission display of claim 10, wherein the dominant contaminant species has sufficiently high mobility on said surface to provide replacement migration.

16. The field emission display of claim 15, wherein said dominant contaminant species is an organic compound.

17. The field emission display of claim 16, wherein said dominant contaminant species is methane.

18. In a field emission display device having a gate and an emitter, wherein the emission current is a function of a gate-to-emitter voltage, a method for adjusting a gate-to-emitter voltage to achieve a predetermined emission current comprising:

acquiring a plurality of data pairs for the gate-to-emitter voltage and emission current;

using said plurality of data pairs, solving for the parameters of the Fowler-Nordheim equation;

computing a required gate-to-emitter voltage for the predetermined emission current using the Fowler-Nordheim equation and the parameters; and, applying the required gate-to-emitter voltage.

19. The method of claim 18 wherein said plurality of data pairs is limited to two data points.

20. The method of claim 19 wherein said parameters are solved for by a curve fit using more than two data pairs.

* * * * *